US008213837B2

(12) United States Patent
Wayman

(10) Patent No.: US 8,213,837 B2
(45) Date of Patent: Jul. 3, 2012

(54) UNIDIRECTIONAL PUMP AUGER SHAFT SEAL FOR DEVELOPER HOUSINGS

(75) Inventor: William H. Wayman, Ontario, NY (US)

(73) Assignee: Xerox Corporation, Norwalk, CT (US)

( * ) Notice: Subject to any disclaimer, the term of this patent is extended or adjusted under 35 U.S.C. 154(b) by 519 days.

(21) Appl. No.: 12/545,913

(22) Filed: Aug. 24, 2009

(65) Prior Publication Data

US 2011/0044719 A1 Feb. 24, 2011

(51) Int. Cl.
*G03G 15/08* (2006.01)
*G03G 21/00* (2006.01)

(52) U.S. Cl. ..... 399/254; 399/102; 399/104; 399/256; 399/258

(58) Field of Classification Search ..... 399/102–104, 399/252, 254, 256, 258
See application file for complete search history.

(56) References Cited

U.S. PATENT DOCUMENTS

| | | | | |
|---|---|---|---|---|
| 5,450,169 | A | 9/1995 | Hart et al. | |
| 6,029,032 | A * | 2/2000 | Watanabe et al. | 399/111 |
| 2005/0175376 | A1* | 8/2005 | Sekiguchi | 399/258 |
| 2007/0189804 | A1* | 8/2007 | Yasumitsu | 399/111 |
| 2008/0065021 | A1* | 3/2008 | Jenkins et al. | 604/167.02 |

* cited by examiner

*Primary Examiner* — David Porta
*Assistant Examiner* — Jessica L Eley
(74) *Attorney, Agent, or Firm* — Ronald E. Prass, Jr.; Prass LLP

(57) ABSTRACT

This is an auger shaft seal used in an electrophotographic marking system. The seal is made up of alternating raised and depressed pie-shaped sections, each having edges that force developer away from auger bearings. The seal of this invention can be used on bi-directional augers and will protect the bearing when the auger moves in a clockwise or counter-clockwise direction. The seal is used with a magnetic seal to add additional protection for the bearings.

12 Claims, 6 Drawing Sheets

UNIDIRECTIONAL PUMP AUGER SHAFT SEAL FOR DEVELOPER HOUSINGS

This invention relates to an electrophotographic marking system and, more specifically, to a shaft seal to be used in a developer station of said system.

BACKGROUND

A typical electrophotographic or electrostatographic reproduction machine employs a photoconductive member that is charged to a substantially uniform potential so as to sensitize the surface thereof. The charged portion of the photoconductive member is exposed to a light image of an original document being reproduced. Exposure of the charged photoconductive member selectively dissipates the charge thereon in the irradiated areas to record an electrostatic latent image on the photoconductive member corresponding to the informational areas contained within the original document.

After the electrostatic latent image is recorded on the photoconductive member, the latent image is developed by bringing a developer material into contact therewith. Generally, the electrostatic latent image is developed with dry developer material comprising carrier granules having toner particles adhering triboelectrically thereto. The toner particles are attracted to the latent image, forming a visible powder image on the photoconductive surface. After the electrostatic latent image is developed with the toner particles, the toner powder image is transferred to a sheet. Thereafter the toner image is heated to permanently fuse it to the sheet.

It is highly desirable to use an electrostatographic reproduction machine of this type to produce color prints. In order to produce a color print, the electrostatographic reproduction machine includes a plurality of stations. Each station has a charging device for charging the photoconductive surface, an exposing device for selectively illuminating the charged portions of the photoconductive surface to record an electrostatic latent image thereon, and a developer unit for developing the electrostatic latent image with toner particles. Each developer unit deposits different color toner particles on the respective electrostatic latent image. The images are developed, at least partially, in superimposed registration with one another, to form a multicolor toner powder image.

The resultant multicolor power image is subsequently transferred to a sheet. The transferred multi-color image is then permanently fused to the sheet forming the color print. In both monochromatic and color systems the developer housing includes rotating components, such as magnetic rolls and augers, that are supported by bearings. These bearings must be kept free of developer material to ensure long developer housing life. Augers used to transport material in developer housings can push material towards bearings leading to premature bearing failures.

Some developer housings incorporate "pump auger" style shaft seals. These work by incorporating a directional screw thread on the rotating shaft which is in contact with a captive brush of developer material. The captive brush is created by a stationary surrounding ring magnet. The rotating screw threads actively push or "pump" material away from the bearing of the pump augers. This design has proven effective and shows increased life over just using a stationary ring magnet surrounding the rotating shaft. Unfortunately, some new developer designs must also run backwards for the purpose of dumping the developer material. There have been numerous bearing failures when pump auger seals were added to a developer housing that must periodically run backwards. When run backwards, the pump auger seals will pump material towards the bearing, leading to premature bearing failures.

At a development station, a development system or developer unit develops the latent image recorded on the photoconductive surface. A chamber in a developer housing stores a supply of developer material. To convey the developer material in the chamber to the latent image and to mix and triboelectrically charge the developer, a series of augers and magnetic rollers are strategically placed in the chamber and supported by the developer housing. Since these augers and rollers rotate, bearings are used to support the rollers at the housing.

The bearing is typically a sealed ball bearing having lip seal on both sides thereof. The auger is located in a chamber formed by a developer housing. The chamber contains developer material which is transported, agitated and mixed by the auger. The auger extends through an opening in the developer housing. The magnetic seal is located in the opening adjacent the chamber. The bearing is located adjacent an outer face of the developer housing. Magnetized carrier granules are magnetically attracted to the magnetic seal and form a barrier in the opening of the housing. If the bearing does not use grease, the lip seals may not be absolutely necessary. However, the magnetic seals are not completely effective in containing the toner or carrier. When vibrations and mechanical forces are present in the developer housing, the magnetic attraction of the beads to the magnet are not sufficient to overcome the vibrations and mechanical forces and toner or carrier beads will pass through the seal. U.S. Pat. No. 5,450,169 (Hart) discloses magnetic seals used in electrophotographic development stations. Hart is incorporated by reference into the disclosure of the present invention.

SUMMARY

This invention provides a unidirectional type shaft seal. The seal will work effectively in either shaft rotational direction. Similar to the old prior art design, it (the present invention) the seal will incorporate a multi pole ring magnet to create a captive brush of developer material, but instead of threads riding in the brush, it will incorporate angled radial slots or raised pie shaped indentations. The edges of the indentations will catch and drive the material away from the bearing as the material climbs out of the indentation. However, when the brush drops into the indentation, there will be little or no driving force towards the bearing.

As the pie shaped indentations pass under the captive brush, each rising edge causes the captive developer material to step up which will drive the material away from the bearing. But although the step-down or depressed area is angled towards the bearing, the developer material will not catch on this edge and will not be driven towards the bearing by falling off of an edge. When the shaft direction is reversed, the falling edge is now the rising edge and will again push developer material away from the bearing.

As above noted, this invention provides a unidirectional pump auger shaft seal for developer housings. Current Xerox developer housings use a pump auger style shaft seal. These have a directional screw thread incorporated on the rotating shaft. This is in contact with a captive brush of developer material, which is created by a stationary surrounding multi pole ring magnet. The rotating screw threads pump material away from the bearing. This design has been effective. The developer housing for new products needs also to run in a backwards direction. Unfortunately, this periodic reverse rotation pumps material into the bearing, causing binding and bearing failures.

It is a feature of the present invention to replace the screw feature with a shaft seal having a series of triangular areas and recesses. As the shaft is rotated in either direction, material is driven away from the bearing since it always travels down the incline along the land or raised areas in the recesses. This invention will improve bearing sealing for systems that need to run in both a clockwise and a counterclockwise direction.

DETAILED DISCUSSION OF DRAWINGS AND PREFERRED EMBODIMENTS

Figure 1:
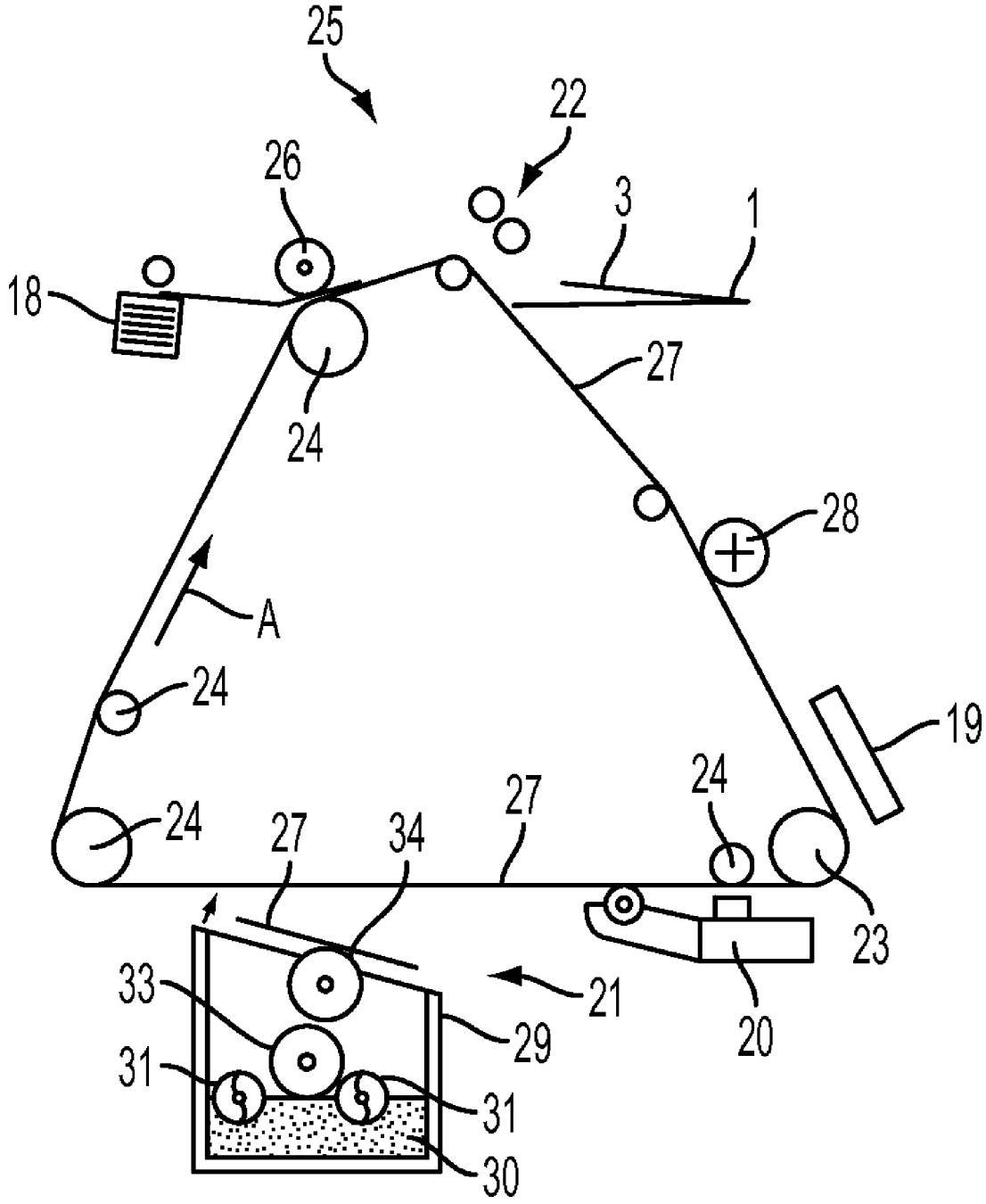
FIG. 1 is a schematic view of a typical electrophotographic marking system that may use the auger shaft seal of this invention.

In FIG. 1, a typical electrophotographic or xerographic monochrome marking system 25 that can use the seal of this invention is illustrated having the "conventional xerographic" stations, i.e. paper feed station 18, charging station 19, exposure station 20, developer station 21, fusing station 22, transfer station 26, cleaning station 28, and collection station 1 with wire stacking tray 3. The motor 23 drives the photoconductive belt 27 around rollers 24 through each station as indicated by the direction arrows. The paper sheet collection station 1 is configured to accept the imaged paper or media.

At the developer station 21, a developer housing 29 contains developer material 30 and augers 31 that are used to transfer, agitate and triboelectrically charge the developer material 30 within housing 29. At the outer periphery of each auger 31 is a bearing 32 (see FIG. 2). Generally the bearings 32 are shielded by various type seals, including magnetic shields. The augers 31 transfer developer material 30 to a transfer roller 33 and then to a developer roller 34. The developer roller 34 then transfers developer to the photoconductive belt 27 to develop the latent image on the belt 27 before transfer of the toned image to the paper or other media.

Figure 2:
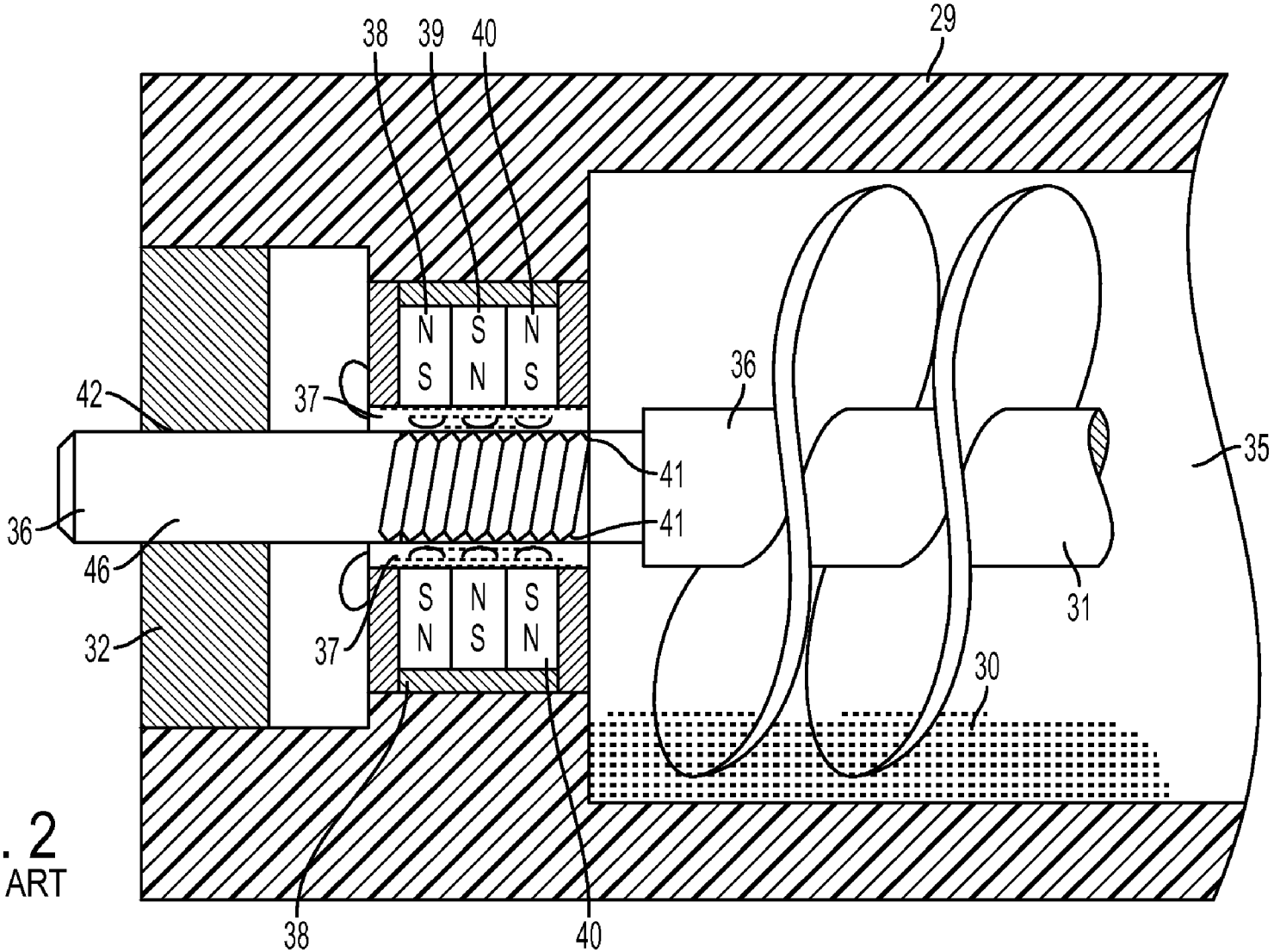
FIG. 2 PRIOR ART
FIG. 2 is a prior art development housing using the prior art directional rotating screw threads pump auger style shaft seals.

In FIG. 2 a developer housing 29 of developer station 21 contains developer material 30 that is agitated by augers 31 having a bearing 32 attached at its terminal end. The developer 30 and auger 31 are in chamber 35. As the auger(s) 31 turn, they agitate the developer composition 30 and move the developer 30 toward the location of bearing 32. Between the end of the auger 36 and the bearing 32 is a magnetic seal 37 made up of magnets 38, 39 and 40. A screw thread seal 41 is used as an additional seal in the prior art to prevent (together with the magnetic seal 37) or minimize the accumulation of developer around the bearing bore 42.

Figure 3:
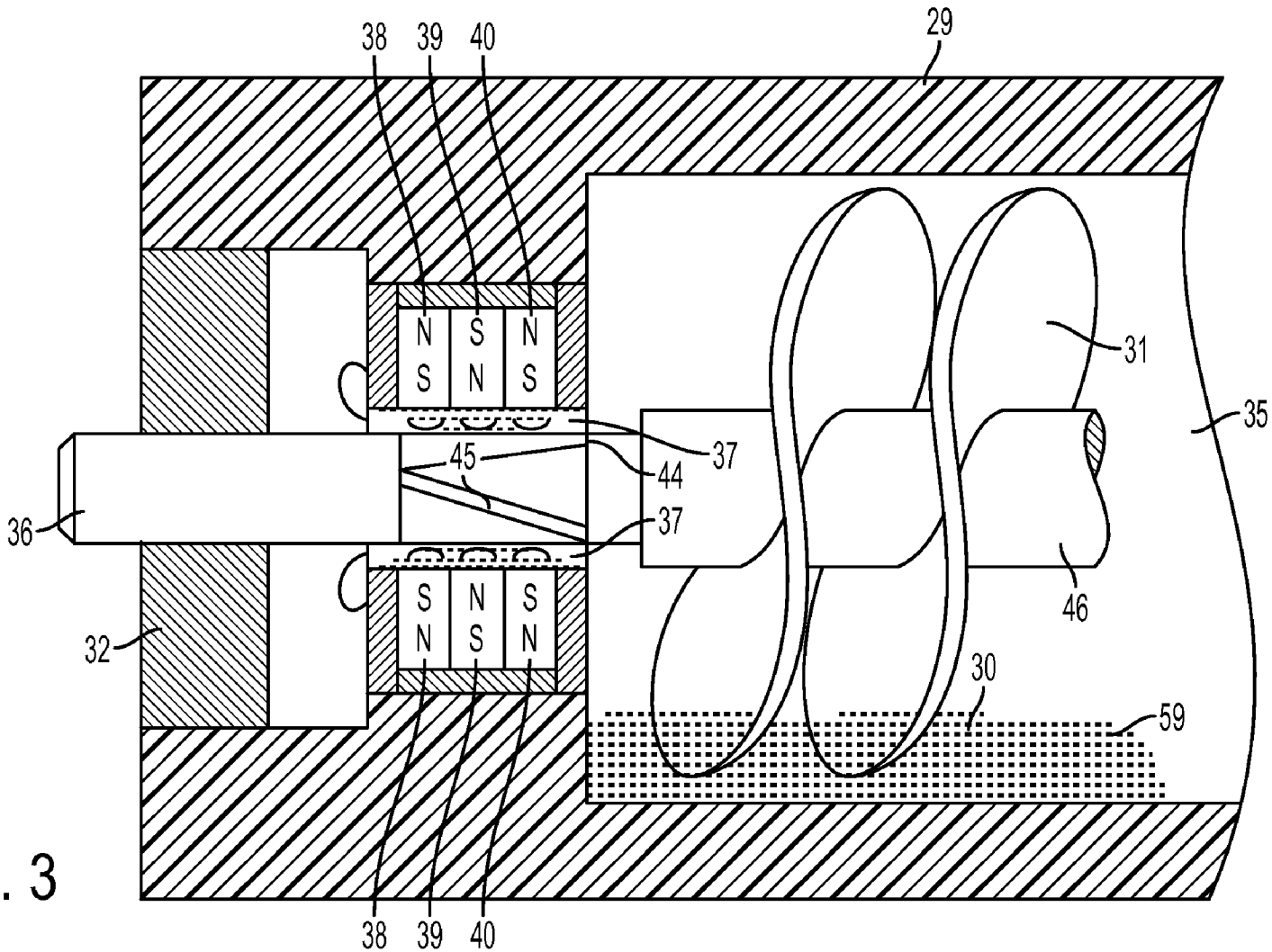
FIG. 3 is a partial sectional view of a multiple magnetic seal configuration for a development housing using an embodiment of the pump auger seal of the present invention.
Figure 5:
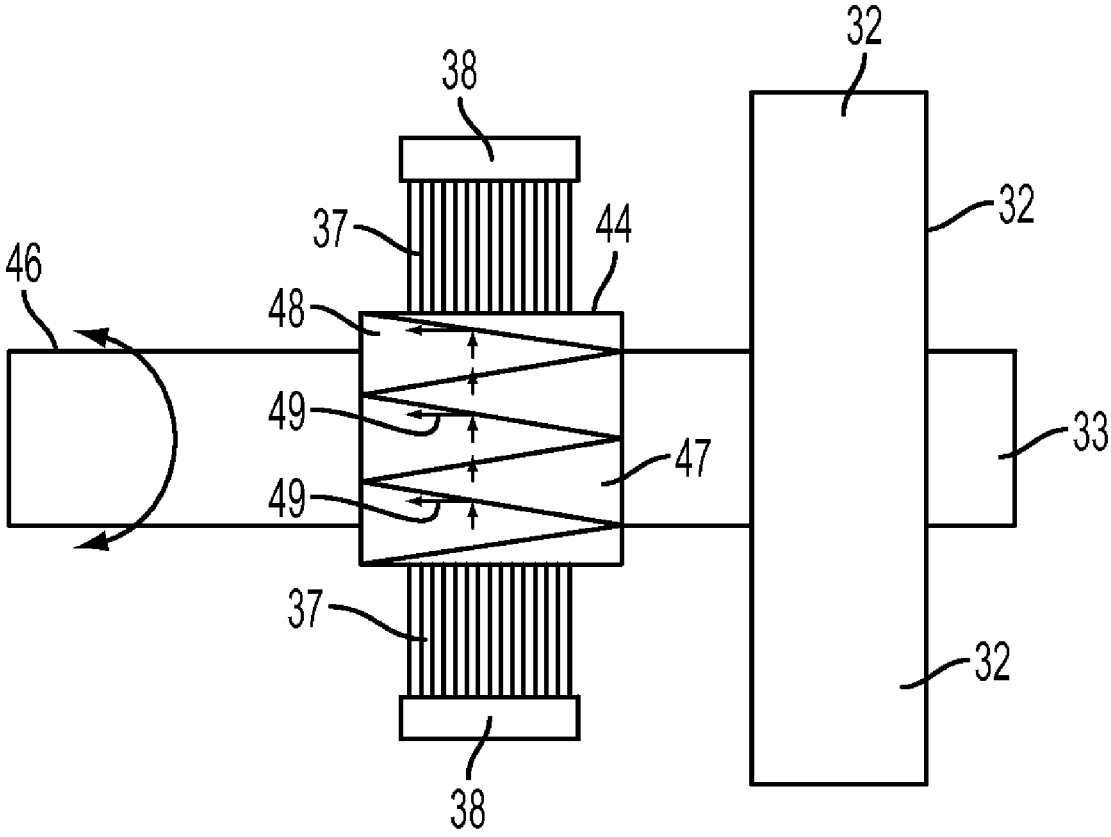
FIG. 5 is a plan view of the seal of this invention as installed in the developer housing.

FIG. 3 shows the shaft seal 44 of the present invention as it is installed in a developer unit 29. This unidirectional shaft seal 44 will work effectively in either rotational direction of augers 31. The edges 45 of the raised areas and indentations 46 will catch and direct developer material 30 away from the bearing 32. As noted, the seal 44 will work effectively in either rotation direction. Similar to the old design, it will incorporate a ring magnet seal 37 to create a captive brush of developer material, but instead of threads 41 riding in the brush, it will incorporate angled radial slots or raised pie shaped indentations 45. The seal 44 of this invention includes alternating pie-shaped or triangular sections alternating raised sections 47 and recessed sections 48, as shown in FIG. 5.

The edges of the indentations will catch and drive the material 30 away from the bearing 32 as the material 30 climbs out of the indentation 45. However, when the brush 37 drops into the indentation, there will be little or no driving force towards the bearing 32.

As the pie shaped indentations 45 pass under the captive brush 37, each trailing edge causes the material to step up, which will drive the material away from the bearing 32. Although the step-down or depressed area 48 is angled towards the bearing, the developer material 30 will not catch on this edge and will not be driven towards the bearing by failing off of an edge. When the shaft direction is reversed, the falling edge is now the trailing edge and will again pump developer material away from the bearing 32. The seal 44 is made up of raised pie shaped areas 47 and depressed pie shaped areas 48.

Figure 4A:
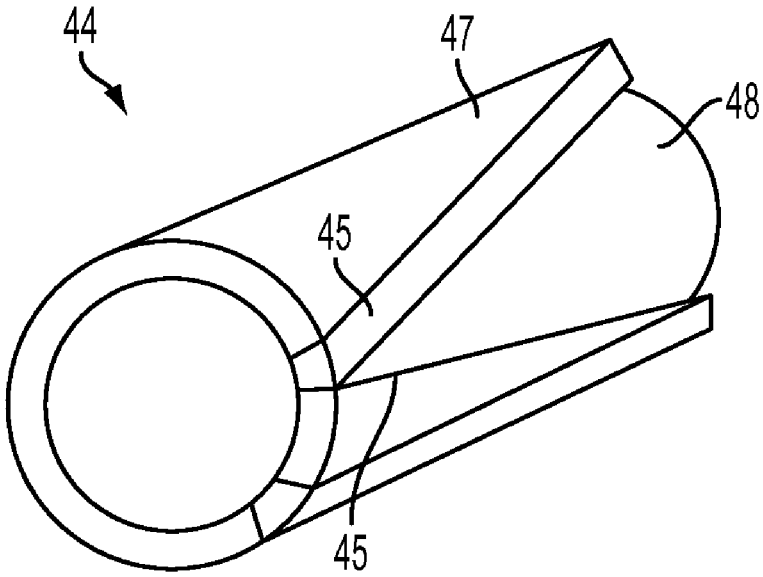
FIG. 4A and 4B are perspective views that illustrate embodiments of the pump auger seal of the present invention.
Figure 4B:
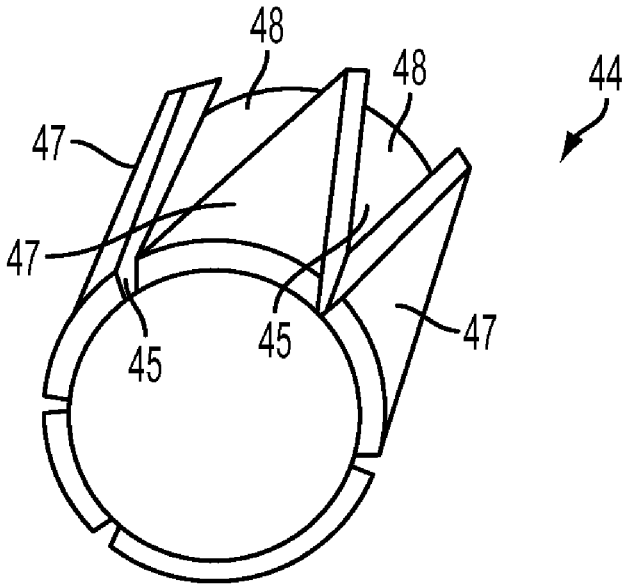

In FIG. 4A, a side view perspective of the seal 44 of this invention is shown. The seal 44 is tubular so as to fit over shaft 46 and is made up of pie shaped raised areas (or land areas) 47 and depressed (or recessed) areas 48. FIG. 4B is a top plan view of the unidirectional shaft seal 44 of this invention.

FIG. 5 is a plan view showing the seal of this invention 44 as used in the developer housing 29 replacing old prior art screw thread seal 41. As earlier noted relative to the other figures, in FIG. 5, the structure or seal 44 of this invention uses a ring magnet 37 to create a captive brush of developer material, but rather than threads 41 (as in the prior art) riding in the brush 37, it will use a seal 44 with the pie-shaped alternating raised (land) areas 47 and pie-shaped recessed or indentation areas 48. The edge portions of indentations 48 will divert developer 30 away from the bearings 32, as the material 30 climbs out of the indentations 45. There will be little or no driving force of the material 30 towards bearing 32. As developer particles or material 30 contacts the edge portions of the seal 44 of this invention, they will be directed or diverted as depicted sat 49 away from bearing 32, as shown in FIG. 5.

Figure 6:
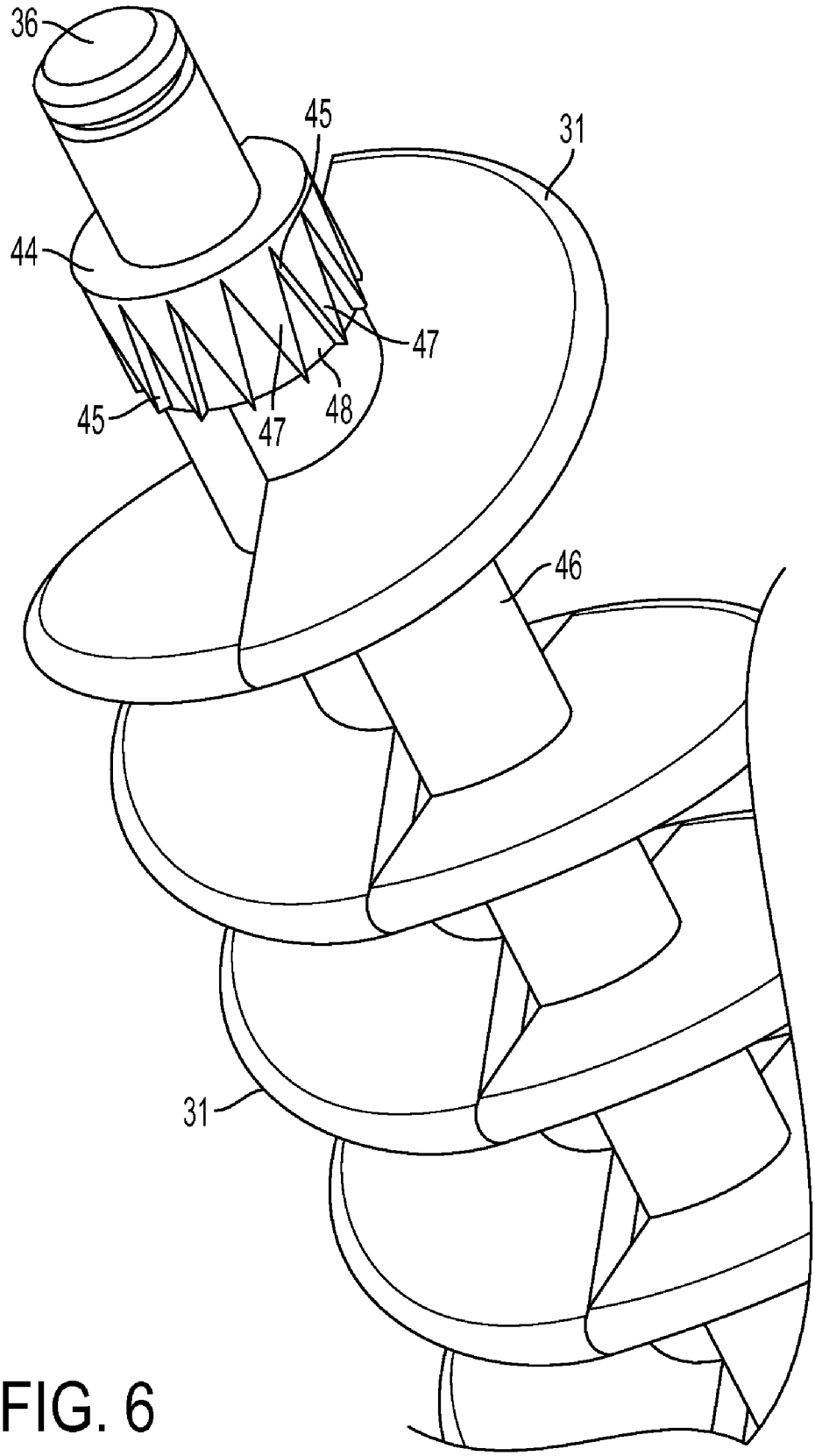
FIG. 6 is a perspective view of an embodiment of the seal of this invention attached to the shaft and auger prior to installation in the development housing.

In FIG. 6 the shaft seal 44 of the present invention is illustrated having raised pie-shaped areas 47 and depressed areas 48. The seal 44 is installed at the end portion 36 of the auger 31 or shaft 46. The bi-directional seal 44 is configured to function in a clockwise or counter-clockwise direction. The edges 45 of the pie-shaped areas will direct developer material 30 and resulting gunk 43 away from bearing 32 so that the life of bearing 32 is significantly extended. The seal 44 of this invention comprises a tubular configuration having alternating raised and depressed pie-shaped areas 47 and 48, respectively. These pie-shaped areas or triangular sections 45 will drive gunk away from bearing 32 when used in electrophotographic marking systems that require a bi-directional auger 31.

In summary, this invention provides: an electrophotographic marking system comprising a developer station in cooperation with other stations of the system, the developer station comprising a developer housing containing a magnetic brush developer, at least one auger in contact with the developer, the auger having an auger shaft and configured to agitate and move the developer towards a latent image to be developed on a photoconductor. The auger has an outside facing bearing on at least one auger terminal section. The unidirectional auger shaft seal of this invention is located adjacent an inner section of the bearing. The auger shaft seal of this invention has a tubular form configured to fit around the auger shaft, the auger shaft seal comprising on its outer surface a series of pie shaped sections. These pie shaped sections comprise alternating raised and depressed pie shaped portions each is configured to divert developer material away from the bearing. The bearing has a bore hole configured to fit around the auger shaft. The bore hole comprises a magnetic seal to minimize contaminants from reaching the bearing(s), the shaft used in the present invention is a bi-directional rotating shaft. The auger shaft seal of this invention is located on the shaft adjacent to an inner section of the bearing and is surrounded by a multi pole magnetic seal. The depressed pie shaped portions of the seal of this invention are configured to contact and divert developer material away from the bearing. Also provided in this invention is a developer housing located in a developer station of an electrophotographic marking apparatus, the developer housing comprising at least one auger positioned around a bi-directional auger shaft, the auger is in contact with a developer material located in the developer housing. The auger shaft extends through the developer housing and has a bearing on each of its terminal ends.

In the present invention, adjacent to an inner face of each bearing is positioned a shaft seal comprising a tubular structure having on its outer surface a plurality of alternating pie shaped raised and depressed sections. As noted earlier, the shaft seal of this invention is configured to divert any developer material in contact therewith away from the bearing. The auger shaft is a bi-directional shaft configured to move the auger in both a clockwise and counter clockwise direction. Thus, the shaft seal of this invention has a series of pie shaped or triangular areas, the triangular areas comprising raised or land sections, each adjacent to depressed or recessed pie-shaped areas, the land sections configured to force developer material to travel along its edges adjacent to the recessed areas. The shaft seal in one embodiment is used on the shaft together with a magnetic brush seal, this magnetic brush seal is surrounding the shaft seal of the present invention to provide additional sealing capacity. This invention described above provides a bi-directional auger shaft seal useful in an electrophotographic marking system.

The shaft seal of this invention comprises pie shaped or triangular sections extending horizontally substantially parallel with the shaft extending along a length of the shaft seal, the triangular sections have points alternatively pointing toward and away from the bearings.

Alternatively, the seal may be configured as a face seal where the magnet is shaped like a flat washer positioned on the inside face of the developer housing. The rotating shaft is centered in this magnet. The rotating pump seal is now a flat pie shaped section with it's triangular indentations and is attached to the rotating shaft and is in close proximity to the magnetic washer. Alternatively the pump seal may be attached to the end wall of the developer housing and the washer shaped magnet attached to the rotating shaft.

It will be appreciated that variations of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. An electrophotographic marking system comprising a developer station in cooperation with other stations of said system, said developer station comprising:

a developer housing containing a magnetic brush developer, at least one auger in contact with said developer, said auger having a shaft and configured to agitate and move said developer towards a latent image to be developed, said auger having an outside bearing on at least one auger terminal section, a unidirectional pump auger shaft seal located adjacent an inner section of said bearing, said auger shaft seal having a tubular form configured to fit around said shaft, said auger shaft seal comprising on its outer surface a series of pie shaped sections, said pie shaped sections comprising alternating raised and depressed pie shaped portions each configured to divert developer material away from said bearing.

2. The marking system of claim 1 wherein said bearing comprises a bore hole configured to fit around said shaft, said bore hole comprising a magnetic seal to minimize contaminants from reaching said bearing.

3. The marking system of claim 1 wherein said shaft is a bi-directional rotating shaft.

4. The marking system of claim 1 wherein said auger shaft seal is located over said shaft adjacent to an inner section of said bearing and surrounded by a magnetic seal.

5. The marking system of claim 1 wherein said depressed pie shaped portions are configured to contact and divert developer material away from said bearing.

6. A developer housing located in a developer station of an electrophotographic marking apparatus, said developer housing comprising:

at least one auger positioned around a bi-directional auger shaft, said auger in contact with a developer material located in said developer housing, said auger shaft extending through said developer housing and having a bearing on each of its terminal ends, adjacent to an inner face of each bearing is positioned a shaft seal comprising a tubular structure having on its outer surface a plurality of alternating pie shaped raised and depressed sections, said shaft seal configured to divert any developer material in contact therewith away from said bearing.

7. The developer housing of claim 6 wherein said auger shaft is a bi-directional shaft configured to move said auger in a clockwise or counter clockwise direction.

8. The developer housing of claim 6 wherein said shaft seal has a series of pie shaped or triangular areas, said triangular areas comprising raised or land sections adjacent to depressed or recessed areas, said land sections configured to allow developer material to travel along its edges adjacent to said recessed areas.

9. The developer housing of claim 6 wherein said shaft seal is configured to divert developer material when said bi-directional auger shaft moves in a clockwise or counter clockwise direction.

10. The developer housing of claim 6 wherein said shaft seal is used on said shaft together with a magnetic brush seal, said magnetic brush seal surrounding said shaft seal to provide additional sealing capacity.

11. A bi-directional pump auger shaft seal useful in an electrophotographic marking system, said shaft seal comprising:

a tubular configuration enabled to fit around a shaft of an auger and having on its outer surface alternating raised and depressed pie shaped sections, said pie shaped sections configured to divert developer material away from bearings located at each end of said shaft, said shaft seal configured to be located adjacent an inner face of said bearings.

12. The shaft seal of claim 11 comprising pie shaped or triangular sections extending horizontally substantially parallel with said shaft extending along a length of said shaft seal, said triangular sections having points alternatively pointing toward and away from said bearings.

* * * * *